US011356774B2

(12) United States Patent
Horiuchi

(10) Patent No.: US 11,356,774 B2
(45) Date of Patent: Jun. 7, 2022

(54) ACOUSTIC SIGNAL MIXING APPARATUS AND NON-TRANSITORY COMPUTER READABLE STORAGE MEDIUM

(71) Applicant: KDDI CORPORATION, Tokyo (JP)

(72) Inventor: Toshiharu Horiuchi, Fujimino (JP)

(73) Assignee: KDDI CORPORATION, Tokyo (JP)

( * ) Notice: Subject to any disclaimer, the term of this patent is extended or adjusted under 35 U.S.C. 154(b) by 0 days.

(21) Appl. No.: 17/186,591

(22) Filed: Feb. 26, 2021

(65) Prior Publication Data

US 2021/0185439 A1 Jun. 17, 2021

Related U.S. Application Data

(63) Continuation of application No. PCT/JP2019/032668, filed on Aug. 21, 2019.

(30) Foreign Application Priority Data

Sep. 27, 2018 (JP) ..... JP2018-182012

(51) Int. Cl.

| | |
|---|---|
| ***H04R 3/00*** | (2006.01) |
| ***H04R 3/12*** | (2006.01) |
| ***H04R 3/14*** | (2006.01) |
| ***H04S 3/00*** | (2006.01) |

(Continued)

(52) U.S. Cl.

CPC ..... *H04R 3/005* (2013.01); *H04R 3/12* (2013.01); *H04R 3/14* (2013.01); *H04S 3/002* (2013.01); *H04S 3/02* (2013.01); *H04S 7/302* (2013.01); *H04S 2400/15* (2013.01); *H04S 2420/01* (2013.01)

(58) Field of Classification Search

CPC ..... H04R 3/005; H04R 3/12; H04S 3/002; H04S 3/02; H04S 7/302; H04S 2400/15; H04S 2420/01

See application file for complete search history.

(56) References Cited

U.S. PATENT DOCUMENTS

2020/0162816 A1 5/2020 Horiuchi

FOREIGN PATENT DOCUMENTS

| | | |
|---|---|---|
| JP | 2003-169399 A | 6/2003 |
| JP | 2006-033501 A | 2/2006 |

(Continued)

OTHER PUBLICATIONS

Horiuchi, et al., "Sound Field Expansion Based on Spectral Modification Between Multiple Channels", ITE Annual Convention 2017, 2 pages.

*Primary Examiner* — Ping Lee

(74) *Attorney, Agent, or Firm* — Foley & Lardner LLP

(57) ABSTRACT

A mixing apparatus includes: a first speaker set processing unit to a P-th speaker set processing unit. K-th speaker set processing unit (K being an integer from 1 to P) includes: a mic set processing unit configured to process acoustic signals output by two microphones of a corresponding microphone set and to output a first acoustic signal and a second acoustic signal. The mic set processing unit configured to process acoustic signals output by two microphones of a corresponding microphone set based on an expansion/contraction coefficient for determining an expansion/contraction rate of a sound field, a shift coefficient for determining a shift amount of a sound field, and an attenuation coefficient for determining an attenuation amount of an acoustic signal output by a microphone.

12 Claims, 8 Drawing Sheets

(51) Int. Cl.
*H04S 3/02* (2006.01)
*H04S 7/00* (2006.01)

(56) References Cited

FOREIGN PATENT DOCUMENTS

| | | | |
|---|---|---|---|
| JP | 3905364 | B2 | 4/2007 |
| JP | 2019-068210 | A | 4/2019 |

ACOUSTIC SIGNAL MIXING APPARATUS AND NON-TRANSITORY COMPUTER READABLE STORAGE MEDIUM

CROSS-REFERENCE TO RELATED APPLICATION(S)

This application is a continuation of International Patent Application No. PCT/JP2019/032668 filed on Aug. 21, 2019, which claims priority to and the benefit of Japanese Patent Application No. 2018-182012 filed on Sep. 27, 2018, the entire disclosures of which are incorporated herein by reference.

BACKGROUND OF THE INVENTION

Field of the Invention

The present invention relates to a technique for mixing acoustic signals obtained by performing sound collection using multiple microphones.

Description of the Related Art

Currently, a virtual reality (VR) system using a head-mounted display has been proposed. In such a VR system, an image corresponding to the field of view of a user wearing the head-mounted display is displayed on a display.

Sound that is to be output from a speaker of the head-mounted display together with these images is, for example, collected by multiple microphones (hereinafter called "mics"). FIG. 1 is an image showing an example of a sound collection method. According to FIG. 1, a total of 8 mics, namely mics 51 to 58, are arranged on a circumference of a circle with a predetermined radius centered about a position 60. If the acoustic signals obtained by performing sound collection using the respective mics 51 to 58 are mixed as-is and output to a speaker, the sounds collected by the respective mics 51 to 58 are output to the speaker at the same level. For example, if the sounds collected by the respective mics 51 to 58 are reproduced at the same level when an image of a range indicated by reference numerals 61 and 62 in FIG. 1 is being displayed on the head-mounted display, a discrepancy occurs between the range being viewed by the user and the range of the sound field.

Japanese Patent No. 3905364 discloses a configuration in which two acoustic signals of a right (R) channel and a left (L) channel are generated by processing the acoustic signals collected by the two mics based on the expansion/contraction rate of the sound field, and one set of (two) speakers is driven using two acoustic signals of the R channel and the L channel, and thereby the range of the sound field is adjusted.

SUMMARY OF THE INVENTION

Although Japanese Patent No. 3905364 discloses driving two speakers by adjusting the range of a sound field of acoustic signals obtained by performing sound collection using multiple mics, Japanese Patent No. 3905364 does not disclose driving three or more speakers by adjusting the range of a sound field of acoustic signals obtained by performing sound collection using multiple mics.

According to an aspect of the present invention, a mixing apparatus for outputting drive signals for respectively driving N (N being an integer that is 3 or more) speakers based on acoustic signals obtained by performing sound collection using a plurality of microphones, includes: a first speaker set processing unit to a P-th (P being N−1 or N) speaker set processing unit corresponding to respective speaker sets of two adjacent speakers among the N speakers, the first speaker set processing unit to the P-th speaker set processing unit each being configured to output a first drive signal for driving a first speaker of a corresponding speaker set, and a second drive signal for driving a second speaker of a corresponding speaker set; and a compositing unit configured to composite drive signals for driving the same speaker among 2P drive signals output by the first speaker set processing unit to the P-th speaker set processing unit. K-th speaker set processing unit (K being an integer from 1 to P) includes: a mic set processing unit that is provided corresponding to each microphone set of two microphones among the plurality of microphones determined based on arrangement positions of the plurality of microphones, and is configured to process acoustic signals output by the two microphones of a corresponding microphone set and to output a first acoustic signal and a second acoustic signal; a first addition unit configured to add the first acoustic signal output by the mic set processing unit corresponding to the microphone set and to output the first drive signal for driving the first speaker of a corresponding speaker set; and a second addition unit configured to add the second acoustic signal output by the mic set processing unit corresponding to the microphone set and to output the second drive signal for driving the second speaker of a corresponding speaker set, and the mic set processing unit configured to process acoustic signals output by two microphones of a corresponding microphone set based on an expansion/contraction coefficient for determining an expansion/contraction rate of a sound field, a shift coefficient for determining a shift amount of a sound field, and an attenuation coefficient for determining an attenuation amount of an acoustic signal output by a microphone.

Other features and advantages of the present invention will become clear through the following description given with reference to the accompanying drawings. Note that in the accompanying drawings, configurations that are the same or similar are denoted by the same reference numerals.

DESCRIPTION OF THE EMBODIMENTS

Hereinafter an exemplary embodiment of the present invention will be described with reference to the drawings. Note that the following embodiment is exemplary and the present invention is not limited to the content of the embodiment. Also, in the following drawings, constituent elements that are not needed in the description of the embodiment are omitted from the drawings.

Figure 1:
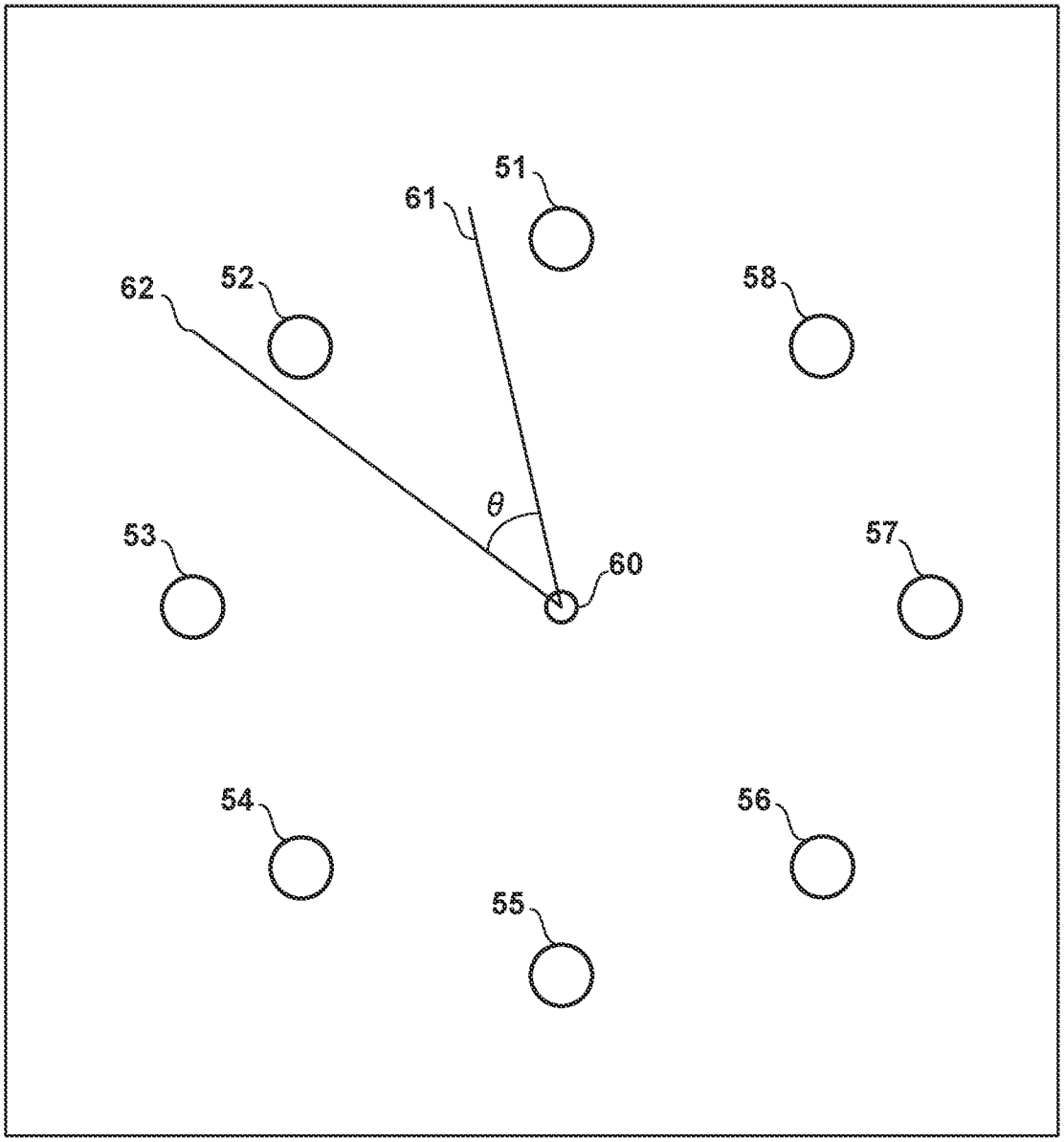
FIG. 1 is a diagram showing an example of a sound collection method.
Figure 2:
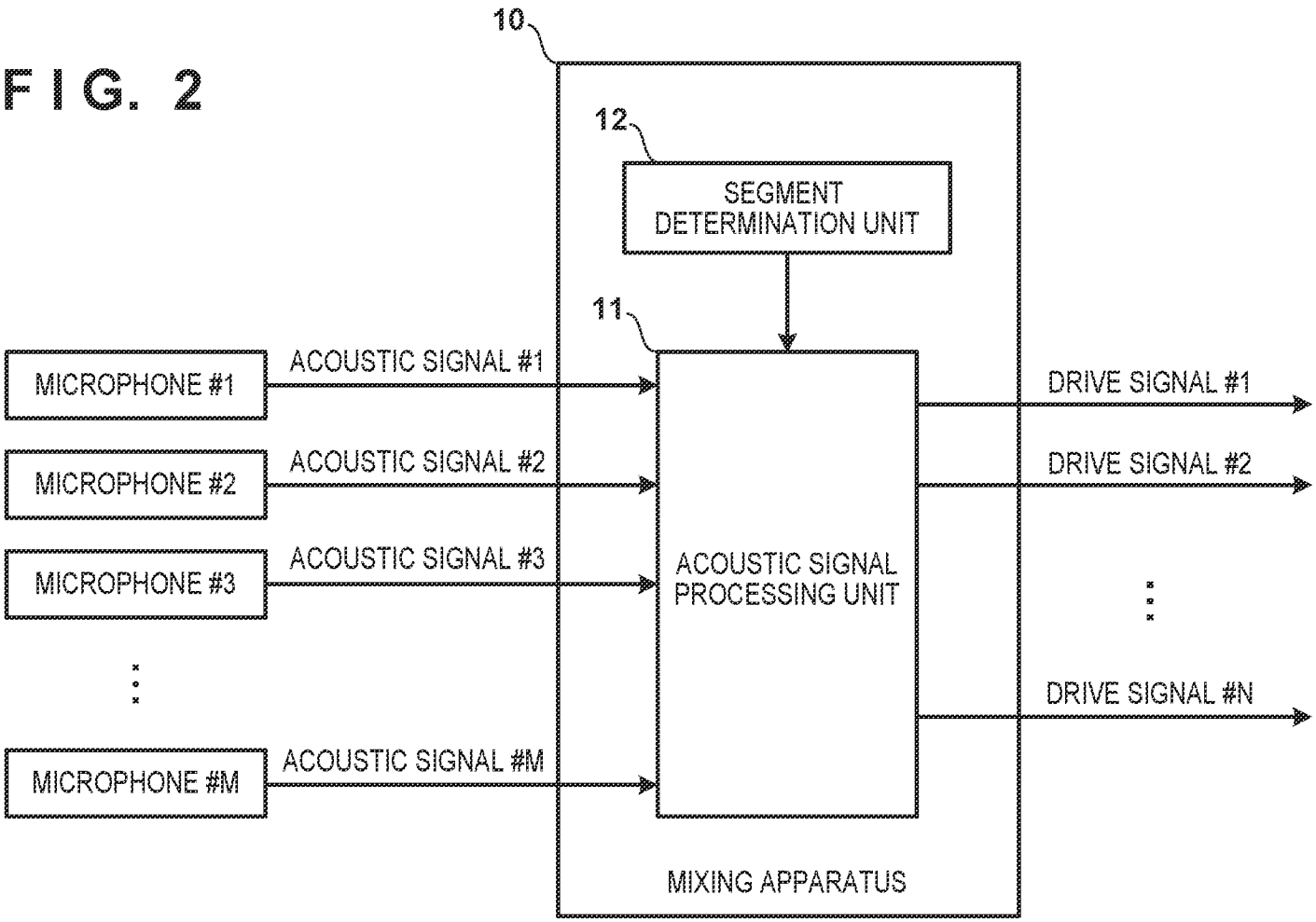
FIG. 2 is a diagram of a configuration of a mixing apparatus according to an embodiment.

FIG. 2 is a diagram of a configuration of a mixing apparatus 10 according to the present embodiment. Acoustic signals #1 to #M obtained by performing sound collection using M mics #1 to #M (M being an integer that is 2 or more) are input to an acoustic signal processing unit 11 of the mixing apparatus 10. For example, as shown in FIG. 1, the mics #1 to #M are arranged on a circumference of a circle with a predetermined radius centered about a position 60. Note that it is also possible to use a configuration in which, for example, multiple mics are arranged not around a circle, but at geographically different locations, such as on a straight line or in any curved shape. Also, mics of multiple directionalities can be arranged facing different directions at the position 60 and perform sound collection. The acoustic signal processing unit 11 outputs drive signals #1 to #N that drive a total of N (N being an integer of 3 or more) speakers #1 to #N based on the acoustic signals #1 to #M. Note that a drive signal #Q (Q being an integer from 1 to N) drives a speaker #Q.

Figure 3:
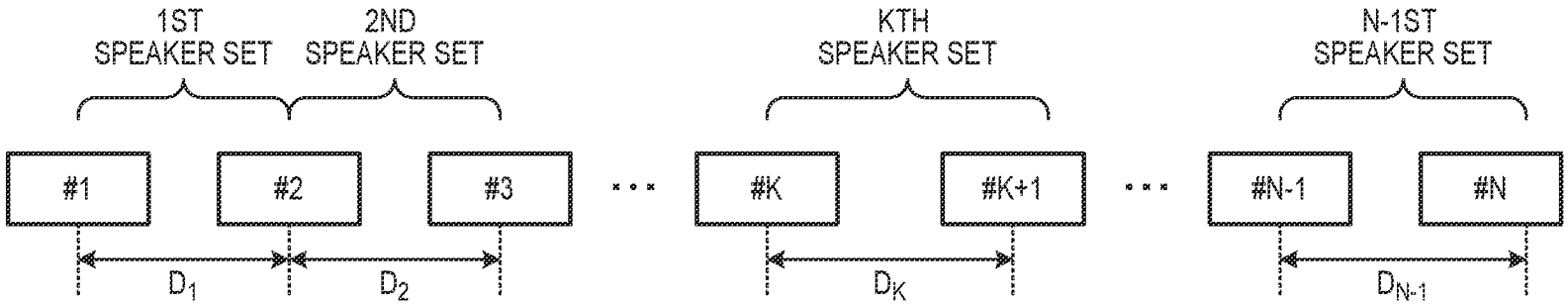
FIG. 3 is an illustrative diagram of a speaker set according to an embodiment.

FIG. 3 is a diagram illustrating a positional relationship between the speakers #1 to #N. As shown in FIG. 3, the speakers #1 to #N are arranged in a line in numerical order along a straight line or a curved line. Note that the distance between the speaker #K and the speaker #(K+1) (K being an integer from 1 to N−1) is $D_K$. Also, two adjacent speakers are defined as one speaker set. In the present embodiment, as shown in FIG. 3, a total of (N−1) speaker sets, namely a first set to an (N−1)-th set can be formed. Note that in the following description, the speaker set of the speaker #K and the speaker #K+1 is a K-th speaker set.

Figure 4:
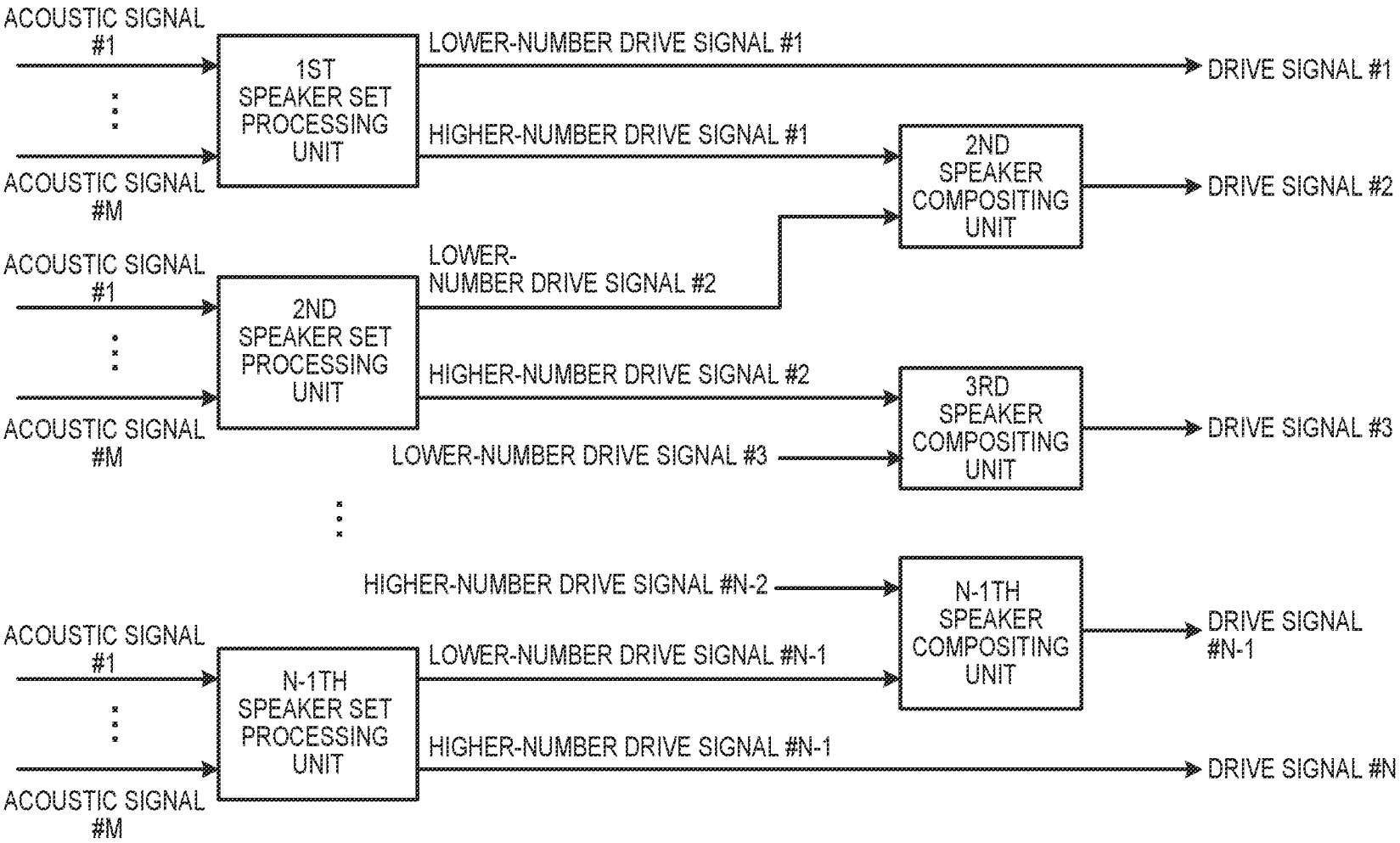
FIG. 4 is a diagram of a configuration of an acoustic signal processing unit according to an embodiment.

FIG. 4 is a diagram of a configuration of the acoustic signal processing unit 11. The acoustic signal processing unit 11 includes a total of (N−1) speaker set processing units corresponding to the speaker sets. Note that the speaker set processing unit corresponding to the K-th speaker set is a K-th speaker set processing unit. The acoustic signals #1 to #M are input to the respective speaker set processing units. The speaker set processing units each output a lower-number drive signal and a higher-number drive signal. The lower-number drive signal is a signal for driving the speaker with the lower number, that is, the speaker #K, among the two speakers #K and #K+1 of the corresponding K-th speaker set, and the higher-number drive signal is a signal for driving the speaker with the higher number, that is, the speaker #K+1, among the two speakers #K and #K+1 of the corresponding K-th speaker set. Note that as shown in FIG. 4, the lower-number drive signal and the higher-number drive signal output by the K-th speaker set processing unit are written as "lower-number drive signal #K" and "higher-number drive signal #K" respectively.

Also, the acoustic signal processing unit 11 includes speaker compositing units corresponding to the respective speakers #2 to #N−1 included in two sets in a speaker set. Note that the speaker compositing unit corresponding to the speaker #X (X being an integer from 2 to N−1) is the X-th speaker compositing unit. Two signals for driving the speaker #X output by the speaker set processing unit, or more specifically, a higher-number drive signal #X−1 and a lower-number drive signal #X, are input to the X-th speaker compositing unit. The X-th speaker compositing unit composites the higher-number drive signal #X−1 and the lower-number drive signal #X and outputs the resulting signal as a drive signal #X. Note that among the total of 2(N−1) signals output by the N−1 set processing units, the signals for driving the speakers #1 and #N are only the lower-number drive signal #1 and the higher-number drive signal #N−1, and therefore the acoustic signal processing unit 11 outputs the lower-number drive signal #1 and the higher-number drive signal #N−1 as the drive signal #1 and the drive signal #N respectively.

Figure 5:
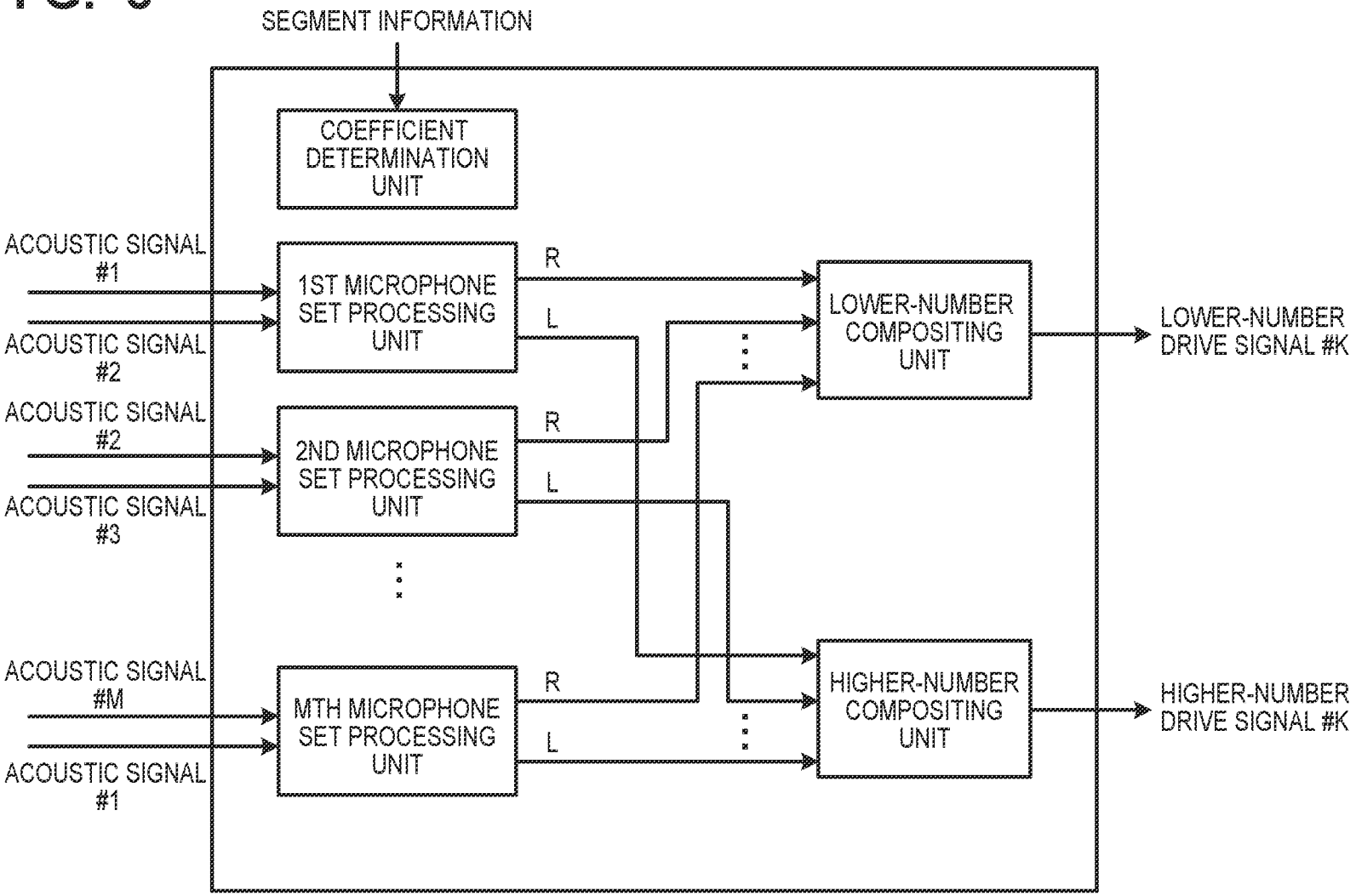
FIG. 5 is a diagram of a configuration of a speaker set processing unit according to an embodiment.

FIG. 5 is a diagram of a configuration of the K-th speaker set processing unit. In the present embodiment, mics whose arrangement positions are adjacent are one mic set. For example, in the arrangement shown in FIG. 1, the mic 51 and the mic 52 are one mic set, and the mic 52 and the mic 53 are one mic set. Hereinafter, similarly, the mic 57 and the mic 58 are one mic set, and the mic 58 and the mic 51 are one mic set. That is, a total of 8 mic sets can be formed in the arrangement shown in FIG. 1. In this manner, if multiple mics are arranged in the form of a closed curved line, M mic sets can be formed with respect to M mics. On the other hand, (M−1) mic sets can be formed with respect to M mics in the case where the multiple mics are arranged in the form of a non-closed line, such as arranging the multiple mics in the form of a straight line. Note that it is also possible to use a configuration in which, even if the multiple mics are arranged in the form of a closed curved line, if the mics are arranged in some segments, (M−1) sets are generated with respect to M mics.

As shown in FIG. 5, the K-th speaker set processing unit is provided with mic set processing units corresponding to a number corresponding to the mic sets. In the present embodiment, M mics are arranged in a circular shape as shown in FIG. 1, and accordingly, it is assumed that there are M mic sets. Accordingly, the K-th speaker set processing unit is provided with a total of M mic set processing units, namely a first mic set processing unit to an M-th mic set processing unit. Note that the processes of the first mic set processing unit to the M-th mic set processing unit are similar. The mic set processing unit outputs an acoustic signal R and an acoustic signal L based on the acoustic signals input from the two mics of the mic set being subjected to processing.

Hereinafter, the processing performed by the mic set processing unit will be described. First, it is assumed that an acoustic signal collected by a mic A will be called an acoustic signal A, an acoustic signal collected by a mic B will be called an acoustic signal B, and the acoustic signal A and the acoustic signal B are input to the mic set processing unit. The mic set processing unit performs a discrete Fourier transform on the acoustic signal A and the acoustic signal B each predetermined time segment. Hereinafter, the signals of the frequency ranges obtained by performing a discrete Fourier transform on the acoustic signal A and the acoustic signal B are a signal A and a signal B respectively. The mic set processing unit generates a signal R (a light channel: corresponds to a lower number) and a signal L (a left channel: corresponding to a higher number) of a frequency range from the signal A and the signal B using the following formula (1). Note that the processing shown in formula (1) is performed for each frequency component (bin) of the signal A and the signal B. Then, the mic set processing unit performs a discrete inverse Fourier transform on the signal R and the signal L of the frequency range and outputs two acoustic signals, namely an acoustic signal R and an acoustic signal L. The lower-number compositing unit adds the acoustic signals R output by the first mic set processing unit to the M-th mic set processing unit and outputs the lower-number drive signal #K. Similarly, the higher-number compositing unit adds the acoustic signals L output by the first mic set processing unit to the M-th mic set processing unit and outputs the higher-number drive signal #K.

$$\begin{pmatrix} R \\ L \end{pmatrix} = MTK\begin{pmatrix} A \\ B \end{pmatrix} \tag{1}$$

$$M = \begin{pmatrix} m_1 & 0 \\ 0 & m_2 \end{pmatrix}$$

$$T = \begin{pmatrix} e^{j\pi f\tau} & 0 \\ 0 & e^{-j\pi f\tau} \end{pmatrix}$$

$$K = \begin{pmatrix} ae^{-jb\Phi} & be^{ja\Phi} \\ be^{-ja\Phi} & ae^{jb\Phi} \end{pmatrix}$$

$$a = (1+\kappa)/2$$

$$b = (1-\kappa)/2$$

In formula (1), f is the frequency (bin) being subjected to processing, and Φ is the principal value of the declination of the acoustic signal A and the acoustic signal B. Accordingly, in formula (1), f and Φ are values that are determined according to the two acoustic signals A and the acoustic signal B being subjected to processing. On the other hand, in formula (1), $m_1$, $m_2$, τ, and κ are variables that are determined by a variable determination unit and notified to the mic set processing units. Hereinafter, the technical meaning of the respective variables will be described.

Figure 6A:
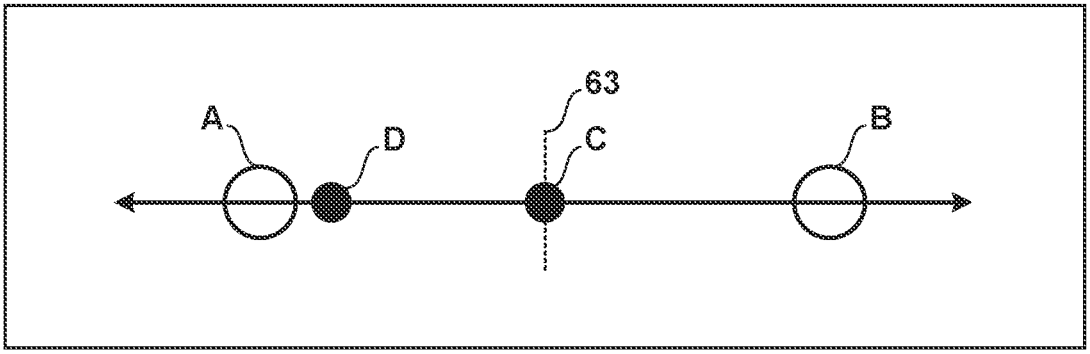
FIG. 6A is an illustrative diagram of coefficients according to an embodiment.

$m_1$ and $m_2$ are attenuation coefficients, and are values that are 0 or more and 1 or less. Note that $m_1$ determines the attenuation amount of the signal A and $m_2$ determines the attenuation amount of the signal B. Hereinafter, it is assumed that $m_1$ is called the attenuation coefficient of the mic A and $m_2$ is called the attenuation coefficient of the mic B.

κ is a scaling (expansion/contraction) coefficient, and determines the range of the sound field. Note that the scaling coefficient κ is a value that is 0 or more and 2 or less. For example, it is assumed that the mic A and the mic B have been arranged as shown in FIG. 6A. Here, it is assumed that $m_1$ and $m_2$ are set to 1, and τ is set to 0. That is, it is assumed that matrices M and T are set to values that do not change the signal A and the signal B at all. At this time, when κ is set to 1, signal R=signal A, and signal L=signal B. That is, the signal R and the signal L are the same as the signal A and the signal B, and thus, the acoustic signal R and the acoustic signal L obtained by performing a discrete inverse Fourier transform on the signal R and the signal L is the same as the signal of the time range collected by the mic A and the mic B. Accordingly, for example, when speakers are placed at the position of the mic A and the mic B and are driven with the acoustic signal R and the acoustic signal L respectively, the range of the sound field in the direction in which the mics A and B are arranged is equal to the sound collection range of the mic A and the mic B as shown in FIG. 6A. For example, it is assumed that sound sources C and D are at the positions shown in FIG. 6A. Note that a position 63 is a middle position of a straight line connecting the mic A and the mic B. In this case, in the generated sound, the positions of acoustic images of the sound source C and the sound source D are positions that are the same as the arrangement positions of the sound source C and the sound source D.

Figure 6B:
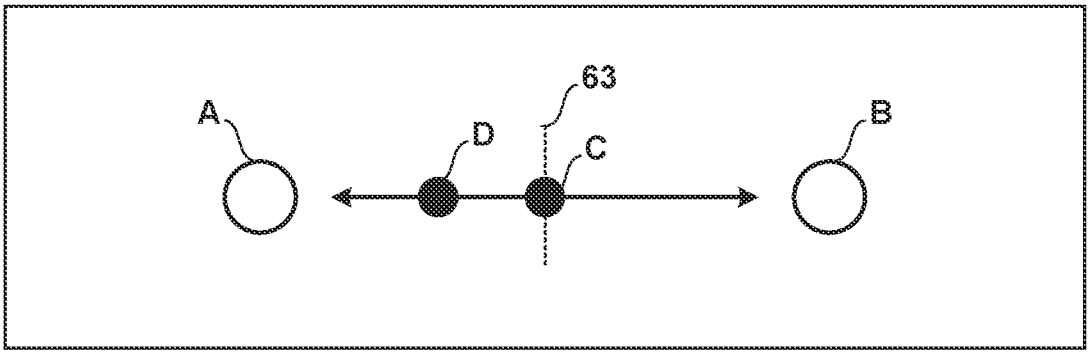
FIG. 6B is an illustrative diagram of coefficients according to an embodiment.
Figure 6C:
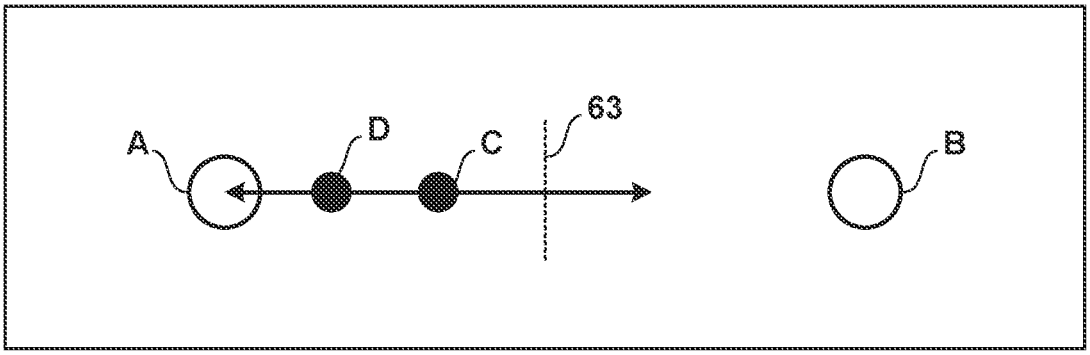
FIG. 6C is an illustrative diagram of coefficients according to an embodiment.

On the other hand, when $m_1$ and $m_2$ are set to 1 and τ is set to 0, if κ is made less than 1, the range of the sound field becomes shorter than when κ is 1, as shown in FIG. 6B. At this time, for example, when the speakers are placed at the positions of the mics A and B and are driven with the acoustic signal R and the acoustic signal L, the position of the acoustic image of the sound source C reaches the middle position 63 that is the same as the arrangement position of the sound source C. However, the position of the acoustic image of the sound source D approaches the middle position 63 with respect to the arranged position of the sound source D. Conversely, if κ is made greater than 1, the range of the sound field becomes longer than when κ is 1. In this manner, the scaling coefficient κ is a coefficient that expands and contracts the range of the sound field.

τ is a shift coefficient, and has a value in a range from −x to +x. When τ=0 as described above, a matrix T has no influence on the signal A and the signal B. On the other hand, when τ=0 is not satisfied, the matrix T provides phase changes with the same absolute value but different signs to the signal A and the signal B. Accordingly, the position of the acoustic field shifts in the direction of the mic A or the mic B. Note that the direction of the shift is determined according to the sign of τ, and the greater the absolute value of τ is, the greater the shift amount is. FIG. 6C shows a range of a sound field obtained when τ has been set to a value other than 0 after setting κ so as to be the range of the sound field shown in FIG. 6B. The positions of the acoustic images of the sound sources C and D are shifted to the left side in the diagram from their positions at the time shown in FIG. 6B. That is, the sound field has shifted to the left side. Note that in FIGS. 6A to 6C, for the sake of description, it is assumed that the speakers are placed at the positions of the mic A and the mic B, but the distance at which the two speakers of the R channel and the L channel are installed can be any distance. In this case, the range of the sound field also corresponds to the installation distance of the speakers.

The coefficient determination unit of the K-th speaker set processing unit determines the coefficients of the first mic set processing unit to the M-th mic set processing unit, that is, $m_1$, $m_2$, τ, and κ, and notifies the first mic set processing unit to the M-th mic set processing unit. Hereinafter, the way in which the coefficient determination unit of the K-th speaker set processing unit determines the coefficients of the mic set processing units will be described.

Figure 7:
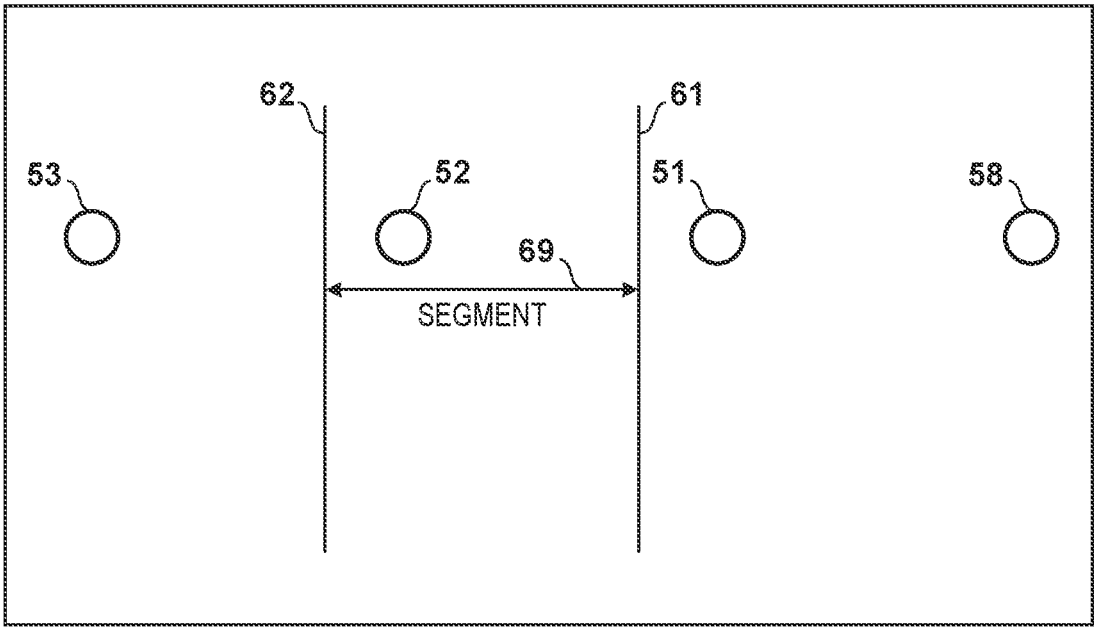
FIG. 7 is an illustrative diagram of a segment according to an embodiment.

Segment information indicating segments is input by a segment determination unit 12 (FIG. 2) to the coefficient determination unit. The segment information is indicated as a segment extending along a straight line or a curved line on which the multiple mics are arranged. For example, as shown in FIG. 1, it is assumed that the mics 51 to 58 are arranged around a circle, and the angle and direction at the central position are designated by the user. That is, it is assumed that the range between a line 61 and a line 62 is designated by the user. In this case, as shown in FIG. 7, a segment 69, which is a range of two intersection points between the circumference of the circle on which the multiple mics are arranged and the lines 61 and 62, is indicated by the segment information. Note that in FIG. 7, the shape of the circumference of the circle is shown as a straight line in order to simplify the description.

Figure 8:
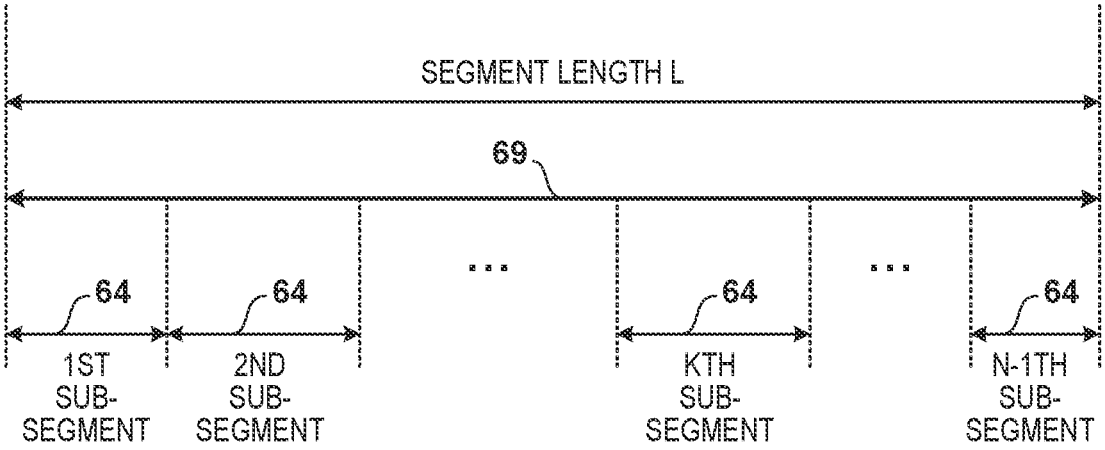
FIG. 8 is an illustrative diagram of sub-segments according to an embodiment.

The coefficient determination unit of the K-th speaker set processing unit stores mic information indicating the arrangement positions of the multiple mics, and speaker information indicating the arrangement positions of the speakers. Also, the segment indicated by the segment information is divided into N−1 sub-segments for each of the first speaker set to the N−1-th speaker set, and the sub-segments corresponding to the K-th speaker set are determined. FIG. 8 shows a state in which the segment 69 indicated by the segment information has been divided into N−1 sub-segments. Here, letting L be the segment length of the segment 69, and $L_1$ to $L_{N-1}$ be the respective lengths of the sub-segments of the first sub-segment to the N−1-th segment, $$L_1:L_2:L_3:\ldots:L_{N-1}=D_1:D_2:D_3:\ldots:D_{N-1}$$

$$L_1+L_2+L_3+\ldots+L_{N-1}=L$$

are satisfied. Note that as shown in FIG. 3, $D_K$ is the distance between the speaker #K and the speaker #K+1 included in the K-th speaker set. The coefficient determination unit of the K-th speaker set processing unit obtains the sub-segments corresponding to the K-th speaker set as the K-th sub-segment 64.

Figure 9A:
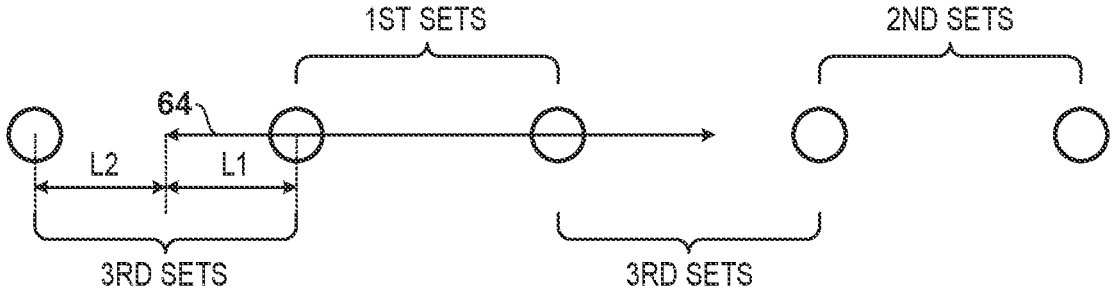
FIG. 9A is an illustrative diagram of a category of a microphone set according to an embodiment.
Figure 9B:
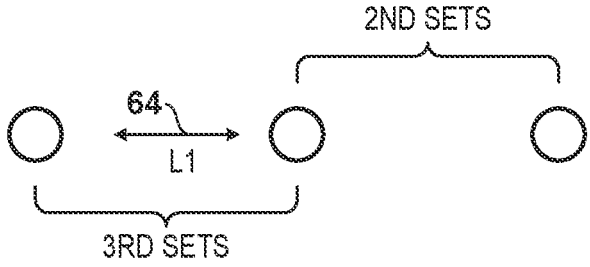
FIG. 9B is an illustrative diagram of a category of a microphone set according to an embodiment.

The coefficient determination unit of the K-th speaker set processing unit categorizes the M-th mic set based on the K-th sub-segment 64 and the arrangement positions of the mics. FIGS. 9A and 9B are diagrams illustrating categorization of the mic set. The circles in FIGS. 9A and 9B indicate the mics. First, the coefficient determination unit determines whether or not at least one mic is included in the K-th sub-segment 64. If at least one mic is included in the K-th sub-segment 64, as shown in FIG. 9A, the coefficient determination unit sets a set, among the M mic sets, in which two mics are both included in the K-th sub-segment 64 as a first set, sets a set in which neither of the two mics is included in the K-th sub-segment 64 as a second set, and sets a set in which one mic is included in the K-th sub-segment 64 but the other mic is not, as a third set. On the other hand, if not even one mic is included in the K-th sub-segment 64, as shown in FIG. 9B, the coefficient determination unit sets a set of two mics that are the closest to the K-th sub-segment 64 as the third set, and sets a set of mics other than that as the second set.

Hereinafter, the way in which the coefficients to be used by the corresponding mic set processing units are determined for the first to third sets will be described. Note that hereinafter, a coefficient to be used by the mic set processing unit of a certain set will be expressed simply as "coefficient of mic set". Also, it is assumed that, as shown in FIGS. 9A and 9B, the length of the K-th sub-segment 64 between the two mics of the third set is set as L1, and the segment of the length L1 is called an overlapping segment. Also, it is assumed that a segment outside of the K-th sub-segment 64 between the two mics in the third set is called a non-overlapping segment. In the case of FIG. 9A, the segment indicated by the distance L2 is a non-overlapping segment, and in FIG. 9B, two non-overlapping segments are present on both sides of the K-th sub-segment 64.

For example, for the first set, the coefficient determination unit sets τ to 0, κ to 1, and for the attenuation coefficient, sets both of the two mics to 1. That is, expansion/contraction and shifting of the sound field are not performed, and the attenuation amount is set to a value according to which the acoustic signals collected by the two mics do not attenuate.

On the other hand, the coefficient determination unit determines the scaling coefficient κ and the shift coefficient τ of the third set such that the range of the sound field corresponds to an overlapping segment. That is, the coefficient determination unit determines the scaling coefficient κ of the third set based on the length L1 of the overlapping segment. Specifically, for example, letting L be the distance between the two mics in the third set, the scaling coefficient for the third set is determined so as to reach an expansion/contraction rate of L1/L. Accordingly, the coefficient determination unit determines the scaling coefficient κ of the third set such that the range of the sound field is shorter the shorter the length of the overlapping segment of the third set is. Also, the coefficient determination unit determines the shift coefficient τ of the third set such that the central position of the sound field is located at the central position of the overlapping segment. Accordingly, the coefficient determination unit determines the shift coefficient of the third set according to the distance between the center of the arrangement position of the two mics and the center of the overlapping segment. Also, the coefficient determination unit sets each of the attenuation coefficients of the two mics in the third set to 1. Alternatively, the coefficient determination unit sets the attenuation coefficient of the mic included in the K-th sub-segment 64 in the third set to a value that is the same as the attenuation coefficients of the two mics in the first set, and sets the attenuation coefficient of the mic not included in the K-th sub-segment 64 so as to be an attenuation amount that is greater than the attenuation amount of the mic included in the K-th sub-segment 64. Alternatively, the coefficient determination unit can set the attenuation coefficient of the mic not included in the K-th sub-segment 64 of the third set such that the attenuation amount increases the greater the length of the non-overlapping segment, that is, the maximum length L2 from the arrangement position of the mic to the K-th sub-segment 64 is.

Furthermore, for example, the coefficient determination unit sets τ to 0 and κ to 1 for the second set, similarly to the first set. However, the attenuation coefficients of the two mics are set to values whose attenuation amounts increase according to the attenuation coefficients set for the mics in the first and third sets. For example, the coefficient determination unit sets the attenuation coefficients of the two mics in the second set to a value at which the attenuation amount is the greater, that is, 0, or to a predetermined value near 0.

Figure 10:
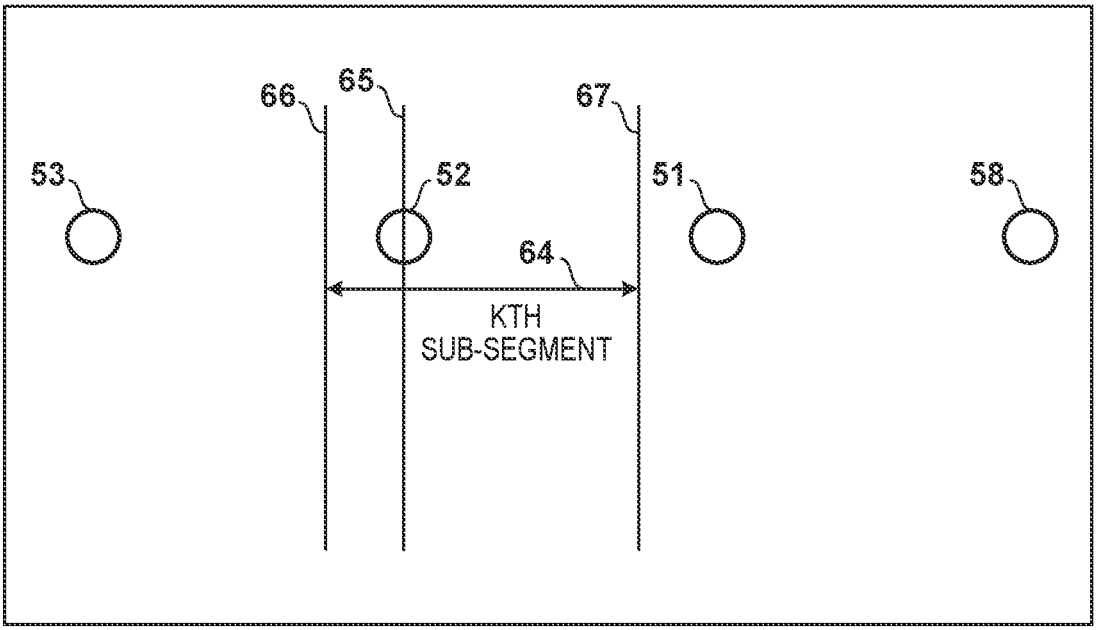
FIG. 10 is an illustrative diagram of a sound field reproduced by a speaker set corresponding to a sub-segment according to an embodiment.

For example, as shown in FIG. 10, it is assumed that the K-th sub-segment 64 is a segment in which a position 66 between the mics 52 and 53 shown in FIG. 1 and a position 67 between the mics 51 and 52 are end points. Note that in order to simplify the drawing, FIG. 10 shows the arrangement of the mics as a straight line. In this case, the set of the mic 51 and the mic 52 and the set of the mic 52 and the mic 53 are both third sets, and the other sets are all second sets. By setting the coefficients as described above, when there are sound sources at the positions of the mics 51 and 52 (hereinafter called sound sources 51 and 52), the position of the acoustic image of the sound source 51 is the position 67 and the position of the acoustic image of the sound source 52 is the position 65. Similarly, when there are sound sources at the positions of the mic 53 and the mic 52 (hereinafter called sound sources 53 and 52), the position of the acoustic image of the sound source 53 is the position 66, and the position of the acoustic image of the sound source 52 is the position 65. Also, since the attenuation amounts for the mics in the second sets are large, the acoustic signals therefrom are hardly included in the lower-number drive signals and the higher-number drive signals output by the K-th speaker set processing unit. According to the configuration above, when the K-th speaker and the K+1-th speaker of the K-th speaker set are driven using the lower-number drive signal and the higher-number drive signal output by the K-th speaker set processing unit, the sound field corresponding to the K-th sub-segment can be reproduced by the K-th speaker set.

In the present embodiment, the acoustic signal processing unit 11 includes the first speaker set processing unit to the N−1-th speaker set processing unit, and the first speaker set processing unit to the N−1-th speaker set processing unit output drive signals corresponding to the speaker sets for reproducing the sound field of the first sub-segment to the N−1-th sub-segment using the two speakers included in each of the first speaker set to the N−1-th speaker set. Then, the acoustic signal processing unit 11 outputs the drive signals for driving the speakers. Note that two signals for driving the same speaker among the 2 (N−1) drive signals output by the first speaker set processing unit to the N−1-th speaker set processing unit are composited. By reproducing the sound fields of the sub-segments to which the speaker sets arranged as shown in FIG. 3 correspond, it is possible to reproduce the sound field of the segment indicated by the segment information using all N speakers.

Finally, the segment determination unit 12 determines the segment based on a user operation. For example, if the user directly designates a segment, the segment determination unit 12 functions as a reception unit for receiving the operation of the user designating the segment. In this case, the segment determination unit 12 outputs the segment designated by the user to the acoustic signal processing unit 11. On the other hand, for example, if applied to viewing of an image on a head-mounted display for VR, or viewing of a 360-degree panorama image on a tablet, the segment determination unit 12 calculates the segment based on the range of the image viewed by the user and outputs the calculated segment to the acoustic signal processing unit 11.

Note that in the present embodiment, the segment is divided into sub-segments according to the proportion of the arrangement interval of the speakers, but if it is a prerequisite that the speakers are arranged at equal intervals, it is possible to use a configuration in which the segments are divided into sub-segments of equal intervals. In this case, the arrangement information indicating the arrangement positions of the speakers is not necessary.

Note that in the present embodiment, N speakers are arranged linearly in numerical order along a straight line or a curved line and (N−1) speaker sets are thus formed. However, N speakers can be arranged on a closed curved line, or for example, on a circular circumference, and the N speakers can form N speaker sets. In this case, in addition to the configuration shown in FIG. 4, the mixing apparatus 10 further includes an N-th speaker set processing unit, a first speaker compositing unit, and an N-th speaker compositing unit. The N-th speaker set processing unit outputs the lower-number drive signal #N and the higher-number drive signal #N. Then, the first speaker compositing unit composites the lower-number drive signal #1 and the higher-number drive signal #N and outputs a drive signal #1. Also, the N-th speaker compositing unit composites the higher-number drive signal #N−1 and the lower-number drive signal #N and outputs the drive signal #N.

The mixing apparatus 10 according to the present invention can be realized using a program that causes a computer including one or more processors and a storage unit to function as the above-described mixing apparatus 10. These programs can be stored in a non-transitory computer-readable storage medium or be distributed via a network. The program is stored in a storage unit and a processor executes the program, and thereby the functions of the units shown in FIG. 2 are realized.

The present invention is not limited to the above-described embodiments, and various changes and modifications are possible without departing from the spirit and scope of the present invention. Accordingly, the following claims are attached in order to apprise the public of the scope of the present invention.

What is claimed is:

1. A mixing apparatus for outputting drive signals for respectively driving N speakers based on acoustic signals obtained by performing sound collection using a plurality of microphones, N being an integer that is 3 or more, the mixing apparatus comprising:

a first speaker set processing unit to a P-th speaker set processing unit corresponding to respective speaker sets of two adjacent speakers among the N speakers, P being N−1, the first speaker set processing unit to the P-th speaker set processing unit each being configured to output a first drive signal for driving a first speaker of a corresponding speaker set, and a second drive signal for driving a second speaker of the corresponding speaker set;

a compositing unit configured to composite drive signals for driving the same speaker among 2P drive signals output by the first speaker set processing unit to the P-th speaker set processing unit; and a reception unit configured to receive a user operation, wherein a K-th speaker set processing unit, K being an integer from 1 to P, includes:

a mic set processing unit that is provided corresponding to each microphone set of two microphones among the plurality of microphones determined based on arrangement positions of the plurality of microphones, and is configured to process acoustic signals output by the two microphones of a corresponding microphone set and to output a first acoustic signal and a second acoustic signal;

a first addition unit configured to add each of the first acoustic signals output by each of the mic set processing units corresponding to the microphone set and to output the first drive signal for driving the first speaker of a corresponding speaker set; and a second addition unit configured to add each of the second acoustic signals output by each of the mic set processing units corresponding to the microphone set and to output the second drive signal for driving the second speaker of a corresponding speaker set, wherein the mic set processing unit is configured to process acoustic signals output by two microphones of a corresponding microphone set based on an expansion/contraction coefficient for determining an expansion/contraction rate of a sound field, a shift coefficient for determining a shift amount of a sound field, and an attenuation coefficient for determining an attenuation amount of an acoustic signal output by a microphone, wherein the K-th speaker set processing unit further includes a K-th determination unit configured to categorize the microphone set based on the user operation and determining the expansion/contraction coefficient, shift coefficient, and attenuation coefficient to be used by the mic set processing unit based on the result of categorizing the microphone set, wherein the plurality of microphones are arranged on a predetermined line, and the two microphones of the microphone set are microphones that are adjacent to each other on the predetermined line, wherein the user operation is an operation of designating a segment on the predetermined line, wherein the K-th determination unit is configured to divide the segment into sub-segments relating to corresponding speaker sets, and when at least one microphone is included in the sub-segment, the K-th determination unit is configured to categorize a microphone set in which two microphones are included in the sub-segment into a first set, categorize a microphone set in which two microphones are not included in the sub-segment into a second set, and categorize a microphone set in which only one microphone is included in the sub-segment into a third set, and wherein when no microphone is included in the sub-segment, the K-th determination unit is configured to categorize a set of two microphones that are the closest to the two ends of the sub-segment into the third set and categorize sets other than the closest to the two ends of the sub-segment into the second set.

2. The mixing apparatus according to claim 1, wherein the K-th determination unit is configured to determine the expansion/contraction coefficient to be used by the mic set processing unit corresponding to the first set and the second set to be a value for which there is no expansion/contraction of the sound field, and determine the shift coefficient to be used by the mic set processing unit corresponding to the first set and the second set to be a value for which there is no shifting of the sound field.

3. The mixing apparatus according to claim 1, wherein the K-th determination unit is configured to determine the expansion/contraction coefficient to be used by the mic set processing unit corresponding to the third set according to a length of the sub-segment between the two microphones in the third set, and determine the shift coefficient to be used by the mic set processing unit corresponding to the third set according to a distance between a center between arrangement positions of the two microphones in the third set and a center of the sub-segment between the two microphones in the third set.

4. The mixing apparatus according to claim 1, wherein the K-th determination unit is configured to determine the attenuation coefficient of the two acoustic signals output by the two microphones in the first set and the attenuation coefficient of the two acoustic signals output by the two microphones in the third set to be a value with a smaller attenuation amount than the attenuation coefficient of the two acoustic signals output by the two microphones in the second set.

5. The mixing apparatus according to claim 4, wherein the K-th determination unit is configured to set the attenuation coefficient of the acoustic signal output by the microphone included in the sub-segment of the third set to be the same as the attenuation coefficient of the two acoustic signals output by the two microphones in the first set.

6. The mixing apparatus according to claim 4, wherein the K-th determination unit is configured to determine the attenuation coefficient of the acoustic signal output by a microphone not included in the sub-segment of the third set to be a value with a larger attenuation amount than the attenuation coefficient of the two acoustic signals output by the two microphones in the first set.

7. The mixing apparatus according to claim 6, wherein the K-th determination unit is configured to determine the attenuation coefficient of the acoustic signal output by the microphone not included in the sub-segment of the third set according to the distance between the arrangement position of the microphone and the sub-segment.

8. The mixing apparatus according to claim 4, wherein the K-th determination unit is configured to determine the attenuation coefficient of the two acoustic signals output by the two microphones in the second set to be a value at which the attenuation amount is the greatest.

9. The mixing apparatus according to claim 1, wherein the K-th determination unit is configured to determine the attenuation coefficient of the two acoustic signals output by the two microphones in the first set to be a value at which the attenuation amount is 0.

10. The mixing apparatus according to claim 1, wherein the K-th determination unit is configured to divide the segment into P sub-segments according to the arrangement interval of the N speakers, and the related sub-segment is a sub-segment divided according to the arrangement positions of the two speakers corresponding to the K-th speaker set processing unit.

11. A non-transitory computer readable storage medium including a program for causing a computer to function as the mixing apparatus according to claim 1.

12. A mixing apparatus for outputting drive signals for respectively driving N speakers based on acoustic signals obtained by performing sound collection using a plurality of microphones, N being an integer that is 3 or more, the mixing apparatus comprising:

a first speaker set processor to a P-th speaker set processor corresponding to respective speaker sets of two adjacent speakers among the N speakers, P being N−1, the first speaker set processor to the P-th speaker set processor each being configured to output a first drive signal for driving a first speaker of a corresponding speaker set, and a second drive signal for driving a second speaker of the corresponding speaker set;

an additional processor configured to:

composite drive signals for driving the same speaker among 2P drive signals output by the first speaker set processor to the P-th speaker set processor; and receive a user operation, wherein a K-th speaker set processor, K being an integer from 1 to P, includes a mic set processor that is provided corresponding to each microphone set of two microphones among the plurality of microphones determined based on arrangement positions of the plurality of microphones, and is configured to process acoustic signals output by the two microphones of a corresponding microphone set and to output a first acoustic signal and a second acoustic signal;

wherein the K-th speaker set processor is configured to:

add each of the first acoustic signals output by each of the mic set processors corresponding to the microphone set and output the first drive signal for driving the first speaker of a corresponding speaker set; and add each of the second acoustic signals output by each of the mic set processors corresponding to the microphone set and output the second drive signal for driving the second speaker of a corresponding speaker set, wherein the mic set processor is configured to process acoustic signals output by two microphones of a corresponding microphone set based on an expansion/contraction coefficient for determining an expansion/contraction rate of a sound field, a shift coefficient for determining a shift amount of a sound field, and an attenuation coefficient for determining an attenuation amount of an acoustic signal output by a microphone, wherein the K-th speaker set processor is configured to categorize the microphone set based on the user operation and determine the expansion/contraction coefficient, shift coefficient, and attenuation coefficient to be used by the mic set processor based on the result of categorizing the microphone set, wherein the plurality of microphones are arranged on a predetermined line, and the two microphones of the microphone set are microphones that are adjacent to each other on the predetermined line, wherein the user operation is an operation of designating a segment on the predetermined line, wherein the K-th speaker set processor is configured to divide the segment into sub-segments relating to corresponding speaker sets, and when at least one microphone is included in the sub-segment, the K-th speaker set processor is configured to categorize a microphone set in which two microphones are included in the sub-segment into a first set, categorize a microphone set in which two microphones are not included in the sub-segment into a second set, and categorize a microphone set in which only one microphone is included in the sub-segment into a third set, and wherein when no microphone is included in the sub-segment, the K-th speaker set processor is configured to categorize a set of two microphones that are the closest to the two ends of the sub-segment into the third set and categorize sets other than the closest to the two ends of the sub-segment into the second set.

* * * * *